US005295715A

United States Patent [19]

Van Blaricom

[11] Patent Number: 5,295,715

[45] Date of Patent: Mar. 22, 1994

[54] SHOCK ABSORBING SKI POLE HANDLE

[76] Inventor: Terry M. Van Blaricom, 6230 Van Nuys Blvd., Van Nuys, Calif. 91401

[21] Appl. No.: 45,658

[22] Filed: Apr. 9, 1993

[51] Int. Cl.[5] ..... A63C 11/22

[52] U.S. Cl. ..... 280/821; 267/74

[58] Field of Search ..... 280/819, 821, 822; 267/73, 74; 135/72, 76; 16/110 R, 111 R, 115

[56] References Cited

U.S. PATENT DOCUMENTS

| | | | |
|---|---|---|---|
| 3,797,845 | 3/1974 | Kepka et al. | 280/821 X |
| 4,061,347 | 12/1977 | Stern et al. | 280/821 |
| 4,244,602 | 1/1981 | Allsop et al. | 280/821 |
| 5,114,186 | 5/1992 | Sugiyama | 280/821 |

FOREIGN PATENT DOCUMENTS

| | | | |
|---|---|---|---|
| 23551 | 2/1981 | European Pat. Off. | 280/821 |
| 2107075 | 6/1972 | Fed. Rep. of Germany | 280/821 |
| 2313095 | 7/1976 | France | 280/821 |
| 20425 | of 1901 | United Kingdom | 280/821 |

*Primary Examiner*—Margaret A. Focarino
*Assistant Examiner*—Michael Mar

[57] ABSTRACT

A ski pole grip having an elastomeric shock absorber. The rate of shock absorption is modified by stretching the elastomer at angles to the direction of movement of the ski pole shaft. Damping is provided by the use of an elastomer with a high degree of natural internal damping.

2 Claims, 2 Drawing Sheets

SHOCK ABSORBING SKI POLE HANDLE

FIELD OF THE INVENTION

This invention relates to ski poles, and more particularly to a ski pole handle that has an elastomeric shock absorber to reduce the chance of injury to the wrists and elbows of the skier.

BACKGROUND OF THE INVENTION

There have been numerous attempts in the prior art to provide the skier with a shock absorbing ski pole or ski pole handle because the planting of the pole into hard snow transmits a substantial shock to the skier's wrists and elbows. The addition of a shock absorbing device to a ski pole greatly reduces the chance of injury to the skier's wrists and elbows.

Some shock absorbing ski poles of the prior art have a metal coil spring inside the ski pole handle to absorb the energy of a pole plant. This spring stores the energy and rebounds with a nearly equal amount of energy that must be dissipated by a damping device. The damping devices of these poles of the prior art use close fitting parts that are costly and require frequent replacement due to wear. Moreover, the metal spring in the handle of these poles must be fabricated from an alloy that will not rust in wet environments which increases the cost of these poles still further, placing them out of reach of the average skier. Other shock absorbing ski poles of the prior art use a rubber elastomer shock absorber to cushion the shock of a pole plant. The type of pole that uses an elastomeric shock absorber in compression has been largely unsuccessful in providing a useful amount of shock reduction because of the limited travel inherent in a compression type elastomeric shock absorber. The type of pole that uses an elastomer in stretch has been largely unsuccessful because elastomers in general have a non-linear rate of stretch that is ill-suited to the absorption of shock in a ski pole.

SUMMARY OF THE INVENTION

The present invention includes a ski pole handle with a elastomeric shock absorber in which the rate of resistance of the elastomer relative to the movement of the ski pole shaft is modified to be more in accord with what is desirable in a shock absorber. This is accomplished by stretching the elastomer at angles to the direction of movement of the ski pole shaft. The elastomer is stretched at a greater angle in the initial moments of the pole plant than in the later moments. This provides a low initial rate of resistance that becomes progressively higher through the duration of the pole plant due to the steadily decreasing angle of stretch relative to the direction of movement of the pole shaft. The natural internal damping that is found in rubber elastomers, and especially in certain elastomers of high durameter, is used to dissipate a portion of both the pole plant energy and the energy of rebound.

The primary object of the invention is to provide a ski pole handle with an elastomeric shock absorber that cushions the shock of planting the pole into hard snow and is thereby effective in reducing the incidence of injury to a skier's wrists and elbows.

Another object of the present invention is to provide a ski pole handle with an elastomeric shock absorber that is of simple but effective design so that it may be sold at a cost that would not be prohibitive to the average skier.

Another object of the present invention is to provide a ski pole handle with an elastomeric shock absorber in which said shock absorber is made more suitable for use in a ski pole by modifying the rate of stretch of the elastomer.

Another object of the present invention is to provide a ski pole handle with an elastomeric shock absorber that has a substantial amount of natural internal damping to dissipate a portion of the energy of the pole plant and of the energy of rebound.

The above objects and features of the invention as well as some additional ones are described in detail below with reference to the preferred embodiment which is illustrated in the accompanying drawings.

DESCRIPTION OF THE PREFERRED EMBODIMENTS

Figure 2:
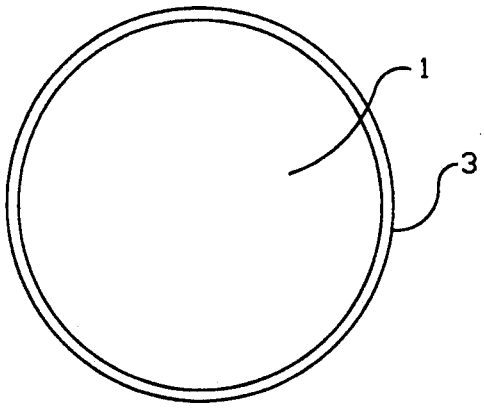
FIG. 2 shows a top view of a shock absorbing ski pole handle in accordance with the present invention.
Figure 1:
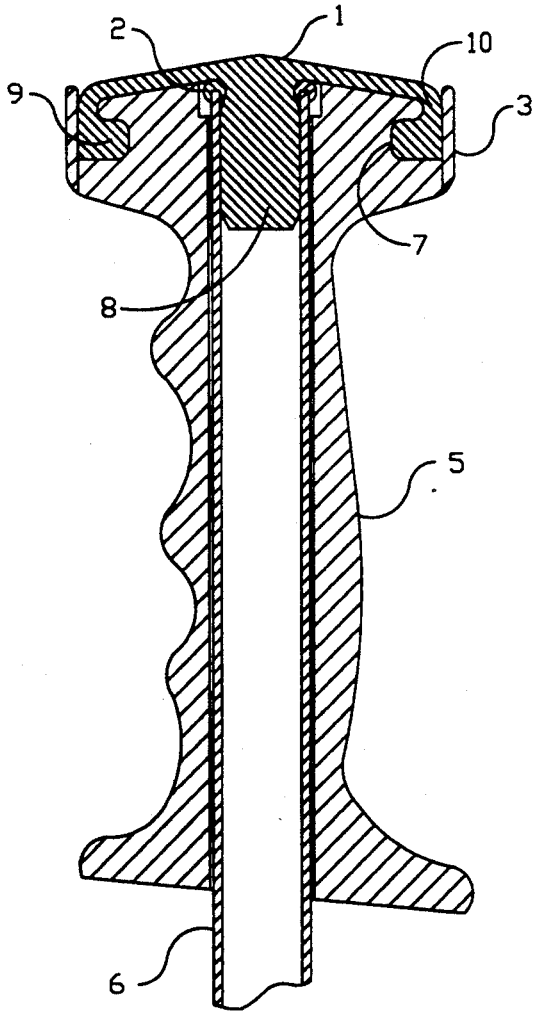
FIG. 1 shows a longitudinal section through a shock absorbing ski pole handle in accordance with the present invention.

Referring in detail to FIGS. 1–5 illustrating the preferred embodiment of the invention, the numeral 6 indicates a portion of a ski pole that is a hollow tubular shaft. Said shaft is fabricated from a high grade of aluminum in this embodiment as is common in the art, but may be made of any material of high modulus that is suitable for use as a ski pole shaft. An elongate hollow grip 5 is mounted at the uppermost portion of and circumjacent to the hollow tubular shaft 6, and is in slidable contact with said shaft. The hollow grip 5 is made of a high durameter urethane rubber that provides a comfortable feel, yet is stiff enough to prevent ovulation when squeezed by the hand, which would cause unwanted friction between the grip and the hollow ski pole shaft. The innermost portion of the elastomeric shock absorber 1 provides a circular mounting plug 8 that is fixedly mounted to the inside of the uppermost portion of the hollow tubular shaft 6. The circumference of the elastomeric shock absorber 1 provides a thickened portion 9 to mount in the circular groove 7 at the uppermost portion of the hollow grip 5. A retaining ring 3 is fixedly attached circumjacent to the periphery of the hollow grip 5 at a point that is just below the circular groove 7. The retaining ring prevents the thickened portion 9 of the elastomeric shock absorber 1 from being pulled through the narrow gap 10 between the uppermost portion of the circular groove 7 and the uppermost portion of the retaining ring 3 when the elastomeric shock absorber is stretched. An edge protector 2 prevents abrasion of the elastomeric shock absorber 1 by the sharp edges of the top portion of the hollow shaft 6 when the pole is in operation.

In operation the skier plants the pole firmly into hard snow which transmits shock upwardly through the hollow tubular shaft 6 to the elastomeric shock absorber 1. The elastomer stretches to absorb the shock energy, isolating it substantially from the hollow grip 5 which moves downward on the shaft in accordance with the stretch of the elastomer. A portion of the shock energy is dissipated by the natural internal damping of the elastomeric material, which also provides damping on the rebound stroke. The amount of damping that the elastomer provides depends on the type and durameter hardness of the elastomer used. The rubber elastomer Buna-n in a 70 durameter hardness has been found to provide nearly the optimum amount of damping in the subject invention.

Figure 5:
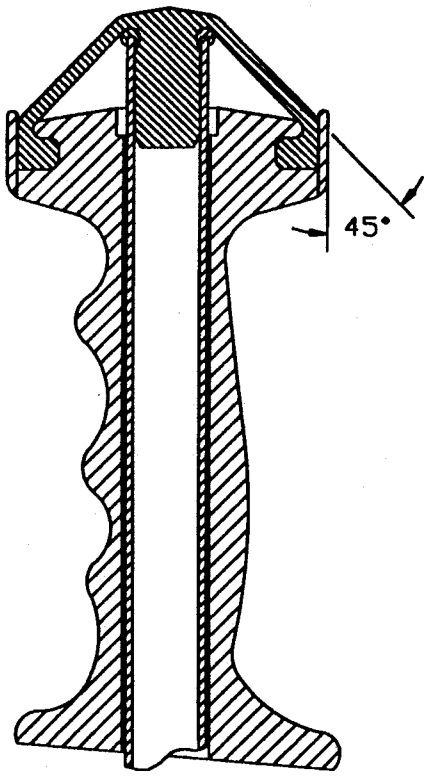
FIG. 5 shows a longitudinal section of a shock absorbing ski pole handle in accordance with the present invention near to the final stages of the pole plant.
Figure 4:
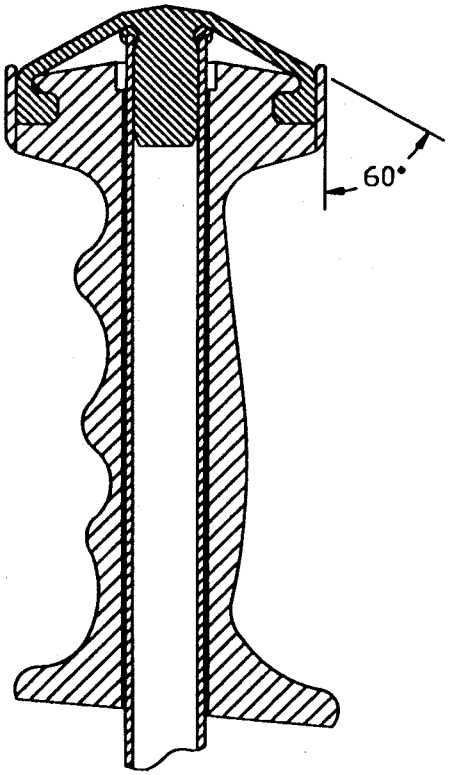
FIG. 4 shows a longitudinal section of a shock absorbing ski pole handle in accordance with the present invention after the pole plant has been initiated but prior to the final stages of said pole plant.
Figure 3:
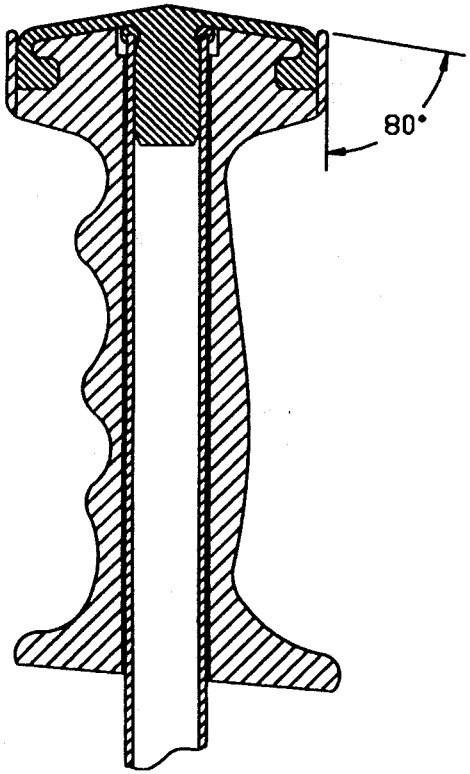
FIG. 3 shows a longitudinal section of a shock absorbing ski pole handle in accordance with the present invention prior to a pole plant into the snow.

Rubber elastomers in general have a rate of stretch that is substantially non-linear in that the resistance in successive increments of stretch will not increase in the amount found in the first increment of stretch. In the present invention the rate of stretch of the elastomer relative to the movement of the ski pole shaft is modified by stretching the elastomer at angles to the movement said shaft. This provides a rising rate of shock absorption that has been shown to be desireable in a ski pole shock absorber. FIG. 3 shows a cross section of the preferred embodiment of the present invention prior to the planting of the ski pole. The initial angle of stretch of the elastomeric shock absorber is 80 degrees to the direction of movement of the ski pole shaft. The ratio of the stretch movement of the elastomer to the sliding movement of the ski pole shaft will be substantially proportional to the sine of this 80 degree angle due to the trigonometric relationship of the sides of the triangle that is formed. At said 80 degree angle, the movement of the ski pole shaft is at a very high ratio to the stretch movement of the elastomer. Accordingly, the ski pole shaft will move upward inside the hollow grip with little resistance from the elastomer in the initial moments of the pole plant. This initial angle of stretch and therefore the initial rate of resistance may be changed to provide shock absorption characteristics that are tailored to the skier and to the resistance curve of the elastomer. FIG. 4 shows a cross section of the present invention at a time that is after the planting of the pole, but before the complete absorption of shock by the rubber elastomer. The angle of stretch of the elastomer has now narrowed to 60 degrees relative to the direction of movement of the pole shaft. The ratio of stretch of the elastomer to the movement of said shaft will be substantially higher at this angle, which provides considerably more resistance to the movement of the ski pole shaft relative to the hollow grip. FIG. 5 shows a cross section of the present invention near to the end of the pole plant. The elastomer has absorbed nearly all of the energy applied and is providing more and more resistance to the movement of the pole shaft because of the decreased angle of stretch of the elastomer relative to the direction of movement of the ski pole shaft.

This embodiment of the subject invention features a replaceable elastomeric shock absorber, however it is conceivable that the elastomer could be molded integrally with the grip or be made not replaceable. It is also conceivable that a bushing of high modulus material could be used between the grip and the shaft to ensure the prevention of ovulation of the hollow portion of the grip or to decrease friction between the grip and the shaft. It is also conceivable that other means of damping could be used in place of or in concert with the natural damping of the rubber elastomer.

Additional embodiments of this invention are conceivable, therefore it is intended that the scope of the invention be limited only by the following claims, and not by the embodiments described above. Reference should be made to the following claims in determining the full scope of the invention.

What is claimed is:

1. A shock absorbing hand grip for attachment to an upper end portion of an elongated tubular ski pole, said hand grip comprising:

a hollow grip portion having a circular passage extending therethrough for receiving said upper end portion of said ski pole in a sliding relationship, said grip portion having an enlarged upper portion with an upper surface which inclines downwardly in a direction extending radially from said passage to an outer circumferential edge and a circular groove extending along a circumferential outer surface of said enlarged upper portion;

a shock absorber portion made of elastomeric material and having a circular configuration, said shock absorber portion including a centrally located circular mounting plug depending downwardly therefrom, said mounting plug being received within said upper end portion of said ski pole, and a thickened portion extending downwardly and inwardly from an outer circumferential edge of said shock absorber, said thickened portion being received within said circular groove of said grip portion; and a retaining ring for securing said thickened portion within said circular groove.

2. The shock absorbing hand grip as defined by claim 1, wherein said ski pole includes an edge protector extending around a circular opening in the upper end portion of said ski pole for preventing abrasion of said shock absorber.

* * * * *